US005357765A

United States Patent [19]

Thomas et al.

[11] Patent Number: 5,357,765

[45] Date of Patent: Oct. 25, 1994

[54] COOLING DEVICE

[75] Inventors: David A. Thomas; McGill: Ian C. McGill, both of Auckland, New Zealand

[73] Assignee: Fisher & Paykel Limited, Auckland, New Zealand

[21] Appl. No.: 111,001

[22] Filed: Aug. 24, 1993

Related U.S. Application Data

[63] Continuation-in-part of Ser. No. 976,212, Nov. 13, 1992, abandoned, which is a continuation-in-part of Ser. No. 784,505, Oct. 31, 1991, Pat. No. 5,209,073.

[30] Foreign Application Priority Data

Nov. 1, 1990 [NZ] New Zealand ..... 235931

[51] Int. Cl.[5] ..... F25D 17/00

[52] U.S. Cl. ..... 62/187; 62/180; 62/229

[58] Field of Search ..... 62/187, 186, 180, 229, 62/157, 158, 231, 203, 208, 213, 182

[56] References Cited

U.S. PATENT DOCUMENTS

| | | | |
|---|---|---|---|
| 3,012,412 | 12/1961 | Muffly | 62/176 |
| 3,248,893 | 5/1966 | McLean | 62/187 X |
| 3,248,894 | 5/1966 | Harbour | 62/156 |
| 3,290,893 | 12/1966 | Haldopoulos | 62/187 |
| 3,411,312 | 11/1968 | Sigl et al. | 62/187 X |
| 4,122,687 | 10/1978 | McKee | 62/156 |
| 4,229,945 | 10/1980 | Griffin et al. | 62/229 |
| 4,307,576 | 12/1981 | Takano et al. | 62/204 |
| 4,338,791 | 7/1982 | Stamp, Jr. et al. | 62/160 |
| 4,481,787 | 11/1984 | Lynch | 62/180 |
| 4,614,092 | 9/1986 | Kim et al. | 62/187 X |

*Primary Examiner*—Harry B. Tanner

*Attorney, Agent, or Firm*—Jacobson, Price, Holman & Stern

[57] ABSTRACT

A cooling device has at least one refrigerator compartment and freezer compartment. Cooling of each compartment is controlled by a microprocessor running through a series of basic priorities which may be over ridden by any one in a series of high priorities. Cooling of both compartments is achieved by passing air across a common evaporator and then through separate passageways associated with each compartment.

13 Claims, 3 Drawing Sheets

COOLING DEVICE

CROSS REFERENCE TO RELATED APPLICATIONS

This application is a Continuation-in-part application of application Ser. No. 07/976,212 filed Nov. 13, 1992, abandoned, which in turn is a Continuation-in-Part application of Ser. No. 07/784,505 filed Oct. 31, 1991.

FIELD OF THE INVENTION

This invention relates to a cooling device and comprises in the preferred form a combined refrigerator and freezer.

DESCRIPTION OF THE PRIOR ART

In domestic appliances such as refrigerator/freezer constructions there is a tendency for the refrigerator compartment to be overcooled. This results in a reduction in the humidity in that compartment which increases tendencies for foodstuffs held in the refrigerator compartment to be dried out. This tendency to overcooling also reduces the overall efficiency of the appliance.

Also, prior refrigerator/freezer constructions have utilised control systems which respond only to the instantaneous temperatures within the various compartments. Short term or transient increases in temperature in these appliances have, therefore, caused the refrigeration plant to be energised. This type of control system has been found to be inefficient.

US patent 4,481,787 discloses a cooling device in which the refrigeration plant is sequentially controlled for operation in three separate modes. The control algorithm aims to efficiently allow each of the compartments to reach set point temperatures by first cooling the refrigeration compartment and then the freezer compartment. There is, however, no allowance made for deciding which compartment should receive cooling if a conflict should arise between the two compartments. Also, there is no allowance made for immediately cooling a chamber should its temperature suddenly rise due to, for example, that compartment's door being left open or a warm object being placed within that compartment.

BRIEF SUMMARY OF THE INVENTION

It is therefore an object of the present invention to provide a cooling device which will obviate or minimise the foregoing disadvantages or which will at least provide the public with a useful choice.

Accordingly, in one aspect, the invention consists in a cooling device comprising two groups of chambers, to be maintained substantially at selected but different temperatures. A first group of chambers comprising a freezer group and a second group of chambers comprising a refrigeration group arranged to be operated at a higher temperature than said freezer group wherein each group comprises at least one chamber. Temperature sensing means arranged to cyclically sense temperature levels in each said group of chambers at substantially predetermined intervals are provided along with temperature data storage means adapted to receive and store sensed temperature data and to establish a temperature history for at least one chamber in at least one said group. Also provided are a refrigeration plant including a compressor, evaporator, and a condenser and a common air flow passageway passing across the evaporator.

Separate air flow passageways are provided from and to said common air flow passageway for each of said two groups of chambers, said separate air flow passageways each being fed by said common air flow passageway. Valve means controlling air flow in each said separate air flow passageway are provided along with air flow control means which determine whether each said valve means is to allow, prevent or merely restrict the air How in a selected separate air flow passageway. Temperature selection means select a temperature at which the evaporator is to run or at least tend towards. Air pressure means cause air movement in said air flow passageways as controlled by said valve means to effect cyclical cooling of said groups of chambers and controlling said valve means, said air pressure means and said compressor to effect cooling of said groups of chambers. Logic sequencing means responsive to data from said temperature data storage means and arranged to pass signals to said cycle control means are also provided to control the sequence of actuation of said air pressure means, said valve means and said compressor in accordance with said data obtained from said temperature data storage means and said programmed instructions. The programmed instructions being in a sequence such that cooling of said freezer group is effected by causing air to flow through said freezer group but not said refrigeration group and over said evaporator with said compressor being energized or not depending on the sensed temperature data in said temperature data storage means from said freezer group. Then, provided the sensed temperature in said freezer group has substantially reached a predetermined low temperature and an appropriate signal has been given by the logic sequencing means to the cycle control means indicating that cooling is required in the refrigeration group, the cycle control means causes air to flow through the refrigeration group but not through the freezer group and over the evaporator with the compressor being energized or not depending on the sensed temperature data in the temperature data storage means from the refrigeration group. Both the air pressure means and the compressor being de-energized by the cycle control means when the sensed temperature in the refrigeration group is at or near a predetermined low temperature. Then selected ones of the above sequences being then cyclically followed according to signals received by the cycle control means from the logic sequencing means as a result of cyclically sensing the temperatures of the freezer and refrigeration groups of chambers.

In a further aspect the invention consists in a cooling device comprising at least two chambers to be substantially maintained at selected but different temperatures. A refrigeration plant, including an evaporator and a condenser, containing refrigerant is also provided. The cooling device includes a common air flow passageway across said evaporator, separate air flow passageways from and to said at least two chambers, said separate air flow passageways each being fed by said common air flow passageway passing across said evaporator. Valve means are provided in each of said separate air flow passageways. Sensing means sense the temperature of a selected one or ones of said at least two chambers while pressure means move air through said air flow passageways. Control means, sensitive to said sensing means, controls the operation of the cooling device such that the state of said refrigeration plant, said pressure means and said valve means are altered in such a way as to maintain a first of said at least two chambers within first preset temperature limits until the temperature of a second chamber exceeds second preset temperature limits. At this time said refrigeration plant is placed in an off state, the states of said valve means are then altered to allow air cooled by the thermal inertia of said evaporator to pass through the passageway to said second chamber. If either the average temperature or the difference in temperature above said preset limits within a chamber exceed further preset limits then said refrigeration plant and said pressure means are placed in an on state and said valve means are placed in states to cause air passing over the evaporator to enter that chamber to cool it within its preset limits.

BRIEF DESCRIPTION OF THE DRAWINGS

One preferred form of the invention will now be described with reference to the accompanying drawings in which.

DETAILED DESCRIPTION OF THE INVENTION

Figure 1:
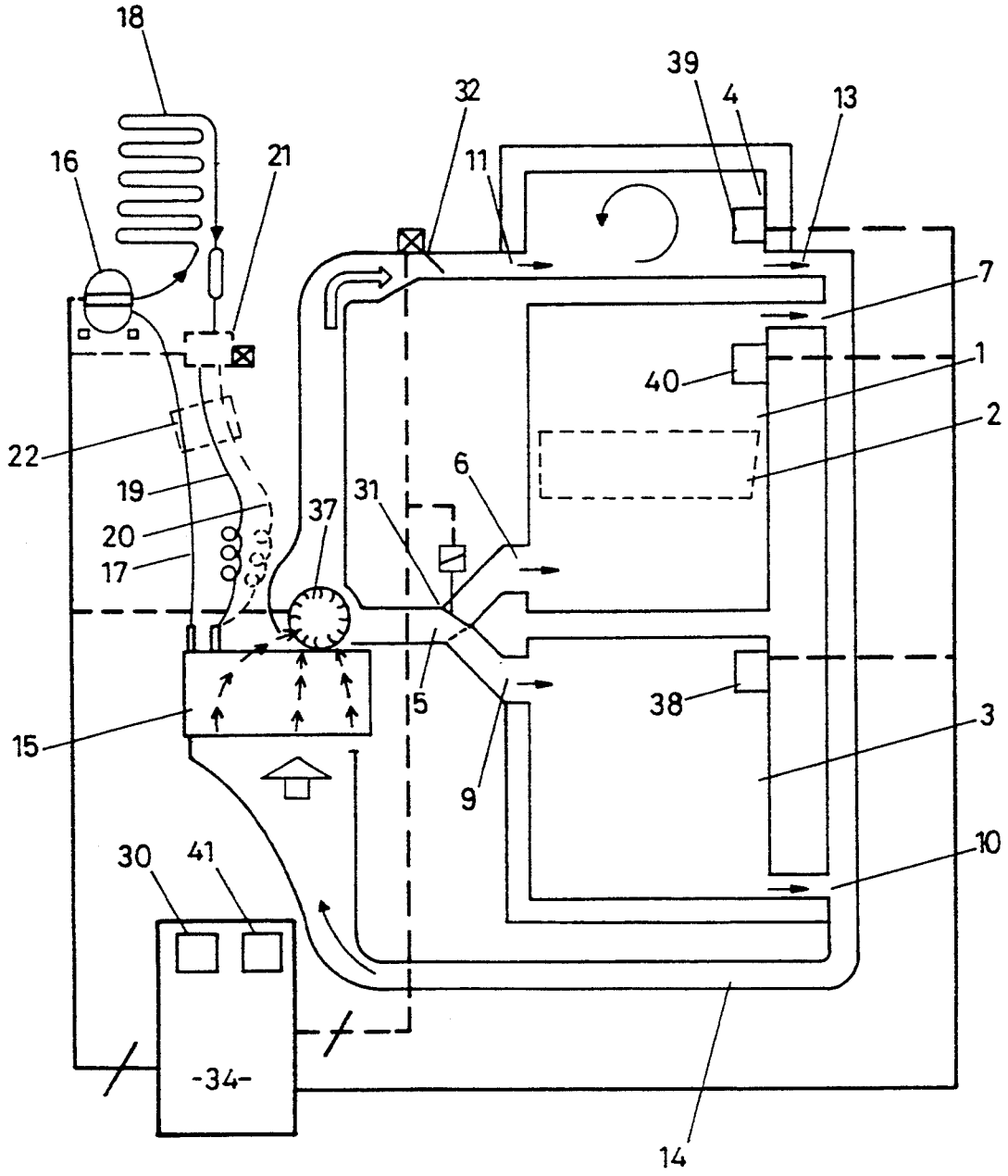
FIG. 1 is a diagrammatic cross-sectional view of a cooling device according to one preferred form of the invention.

Referring to FIG. 1 a cooling device is provided as follows:

A cooling device in the preferred form comprises a combined refrigerator and freezer having at least two compartments including a refrigeration compartment (product compartment) 1 which may include therein a humidity compartment 2. A freezer compartment 3 is provided and in the embodiment described herein a further compartment is provided which is a variable temperature compartment 4.

Air flow passageways are provided through each compartment. Thus an air flow passageway 5 having an inlet 6 is provided to the compartment 1 and an outlet 7 is provided therefrom. The same air flow passageway 5 is terminated in another inlet 9 to compartment 3 and an outlet 10 is provided from the compartment 3. Temperature sensing means, for example temperature sensors 38, 39 and 40 which may comprise thermistors, are positioned within compartments 3, 4 and 1 respectively.

In the embodiment shown in FIG. 1 the variable temperature compartment 4 is fed by a passageway 11 originating from tan 37 and an outlet 13 is provided from the compartment 4. The outlets 7, 10 and 13 may for example meet at a common air flow passageway 14 which passes over an evaporator 15 which forms part of the refrigeration plant of the refrigerator.

Pressure means are provided to move air within the various passageways and this may comprise a multiple speed fan 37 having at least two speeds. However a single speed fan may be adequate. The evaporator 15 passes refrigerant therefrom to a compressor 16 through conduit 17, the refrigerant then passes from the compressor 16 to the condenser 18. From the condenser 18 the refrigerant passes through a capillary 19. A second capillary 20, having a dissimilar diameter and/or length to that of capillary 19, could optionally be provided in which case a suitable switch 21 would also be provided to select the path of the refrigerant through the capillaries. The conduit 17 and capillary 19 (and optional capillary 20 if provided) may be linked by a heat exchanger plate 22 which may be soldered or otherwise affixed to the conduit and capillaries. In an alternative embodiment the capillaries may be soldered together and soldered to the conduit 17.

A controller 34 is shown connected to various components of the cooling device including temperature sensors and refrigeration plant components. Controller 34 incorporates cycle control means, air flow control means and logic sequencing means and may comprise for example a microprocessor with associated temperature data storage means, for example Random Access Memory (RAM) 30.

Adjacent entrance 11 a valve 32 is provided which may take the form of a proportional motor controlled flap valve. Similarly, the intersection of inlets 6 and 9 are provided with a valve 31 which may be for example a two position motor controlled flap valve which may be moved to block either inlet 6 or inlet 9. The movement of valves 31 and 32 is governed by the air flow control means of the controller 34. Thus when valve 32 is closed and valve 31 is positioned to block inlet 6, air flow will be directed through compartment 3 but when valve 32 is closed and valve 31 positioned to block inlet 9, the air flow will be directed through compartment 1- As valve 32 is proportionally controlled, it may be moved between positions where it closes either the air flow passageway 11 or fully opens passageway 11, or to any intermediate position therebetween. Thus the volume of air entering compartment 4 may be controlled in order to vary the temperature of the compartment between those of the freezer and product compartment temperatures. It will be appreciated that compartment 4 is optional.

Operation of the control system of the cooling device will now be described with reference to FIG. 3. A flow diagram representation of programmed instructions executed by the controller 34 and stored by controller 34 for example in Read Only Memory (ROM) 41 shows a series of states 50, 51, and 60 which define the positions (open/closed, on/off etc) of various elements of the cooling device. At any one time, the cooling device may be in only one of these states and more states may be defined as necessary. The decisions which cause changes of these states involve temperatures (sensed by temperature sensors 38, 39 and 40) reaching set points and these decisions are shown between these states. These set point decisions will soon be described, however, it is necessary to note that in conjunction with states changing due to temperatures reaching pre-set levels, the control system of the present invention encompasses a higher level of authority in which a system of priorities have been incorporated. This higher level authority may determine which compartment receives air should each compartment require cooling at substantially the same time or if the temperature history of one of the compartments shows a high average temperature then it should ensure that this compartment is cooled with priority. In order to describe the main control procedures it is, therefore, necessary to first understand the overriding priority system which will now be described with reference to FIG. 2.

Figure 2:
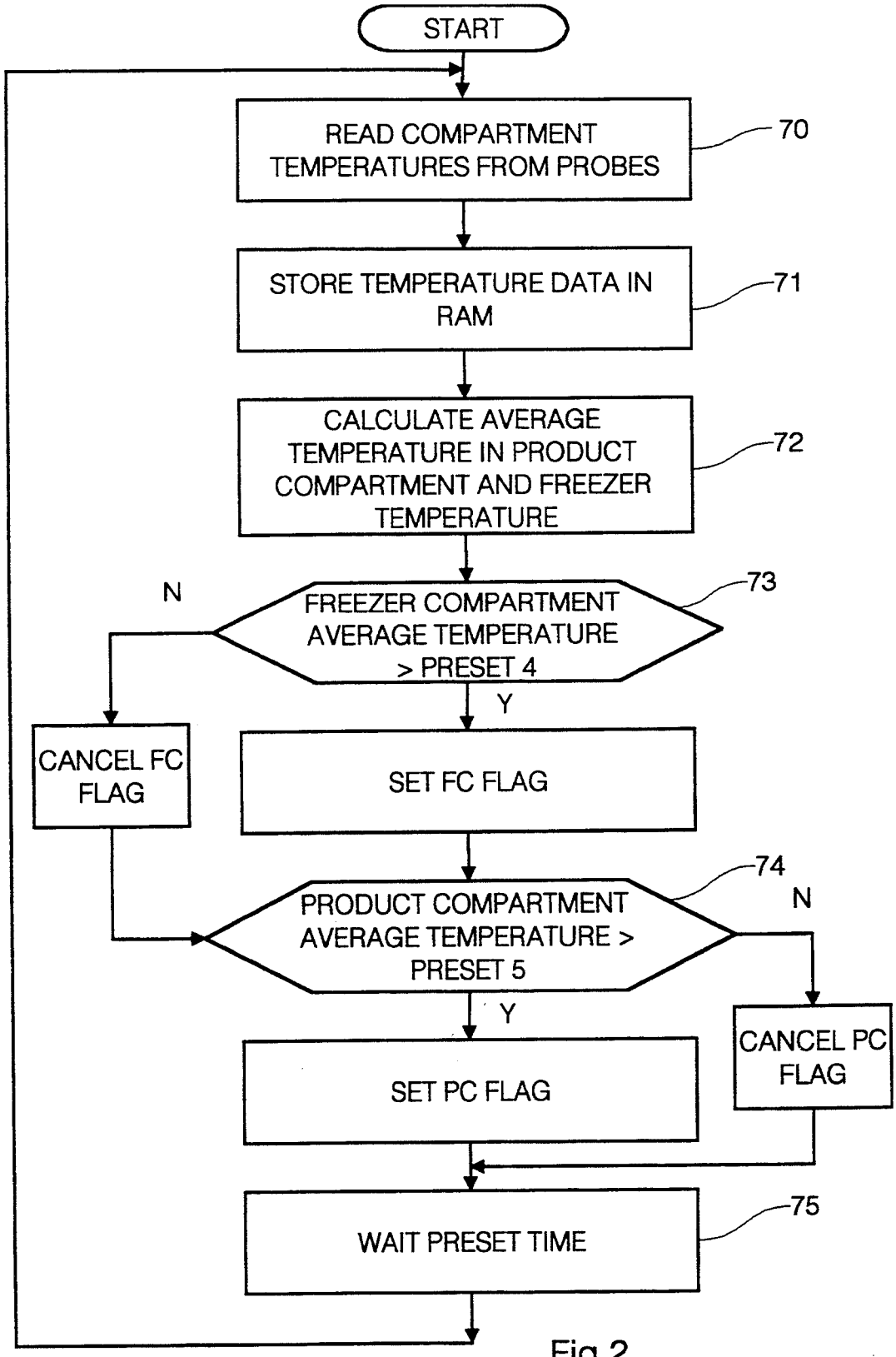
FIG. 2 is a basic flow diagram illustrating the setting of priority to various compartments of the cooling device of FIG. 1.

FIG. 2 is a basic flow diagram, also representative of software executed by the controller 34, in which priority flags relating only to the freezer compartment 3 and product compartment 2 are set. It should be noted that a similar control structure could be developed to set priority flags for the variable temperature compartment or for any other condition or series of events for which it may be useful to assign some form of priority. The How diagram of FIG. 2 could be executed on a timed basis as shown in block 75 or alternatively could be cyclically executed in the flow diagram of FIG. 3 by being incorporated as one of the steps therein.

The priority loop of FIG. 2 is started and progresses to block 70 where temperatures sensed by probes 38, 39 and 40 are read. These values are then stored in RAM 30 at block 71, the values may for example be stored in a the form of tables which keep a history of, for example, the past 30 minutes of readings for each compartment. The controller uses the history of stored temperature values for each compartment to evaluate an AVERAGE TEMPERATURE value for each compartment in block 72. At block 73 the freezer compartment AVERAGE TEMPERATURE is compared to a preset value and a flag (FC FLAG) is set if this preset value has been exceeded. Block 74 evaluates a similar value for the AVERAGE TEMPERATURE in the product compartment and this is compared to another preset value. If the product compartment AVERAGE TEMPERATURE exceeds this preset then its flag (PC FLAG) is set. At block 75 a predetermined time is waited until this loop is repeated or, this finite timer could be removed and the loop could be incorporated as a step in the flow diagram of FIG. 3 as has previously been mentioned.

Figure 3:
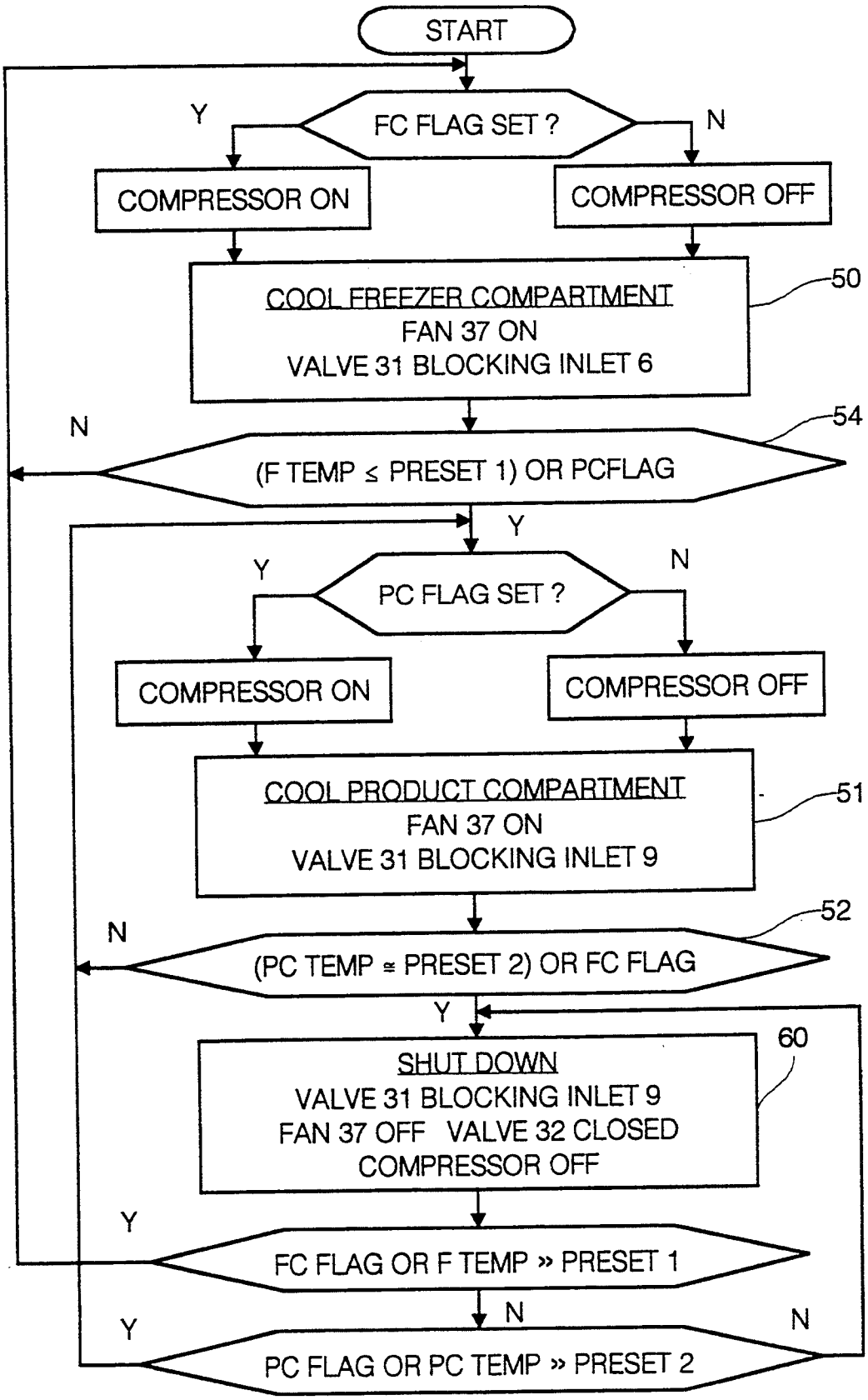
FIG. 3 is a basic flow diagram illustrating the main control loop for the control system of the cooling device of FIG. 1.

Referring now to the flow diagram of FIG. 3, the main control loop consists of a continuously repeated loop. The previously mentioned states 50, 51 and 60 lie within this loop however it should be noted that the loop could be enlarged to include any number of states, the execution of which may be controlled by their own priority flags. In state 50, the freezer compartment is cooled with the compressor on if FC FLAG is set or with the compressor off if the FC FLAG is not set (obviously, if the FC FLAG is set, there will be greater urgency in cooling the freezer compartment). State 50 may be bypassed only by the decision in decision block 54 revealing that the product compartment flag (PC FLAG) has been set by the priority loop of FIG. 2 or that the temperature of the freezer compartment is at an unacceptably low level.

State 51, in which the product compartment is cooled with the compressor turned off (or the compressor on if the PC FLAG is set) is then entered. State 51 is maintained until the product compartment temperature is at or near its preset level or the FC FLAG is set, this may be seen in decision block 52.

If no flags are set, then state 60 is held so long as the temperatures within the compartments are close to their preset levels (that is, within a tolerable temperature range which may also be preset).

It can, therefore, be seen that if a condition were to arise in which a compartment was to require cooling urgently (due to the compartment having an unacceptable average temperature or being too far above its preset limit), then by setting a flag associated with the compartment requiring cooling, immediate action may be taken to remedy the warming compartment by enabling control to move from the present state within the main control loop to a state which will cool the warming compartment.

The valve 32 may simply be set to allow the chamber 4 to be substantially at the same temperature as compartment 3 or compartment I as selected or a proportion of either of these temperatures by controlling the volume flow rate to the compartment. If all compartments are cold enough, then if desired, cold air may be trapped in the compartments (as in block 60) with the refrigeration plant shut down until any of the compartments become too warm or their flags become set.

The compartment 4 may have special override controls, for example for manual setting so that it can be used for example as a fast freeze compartment or can allow items taken from the colder compartment 3 to be thawed to for example about 0° C. This process may be defined in a priority flag loop similar to that explained with reference to FIG. 2.

Thus it can be seen that a cooling device is provided which allows preset temperatures to be met and maintained in various compartments. This tends to minimize tendencies to dry foodstuffs at least in the refrigerator compartment as an improvement in humidity in that compartment is found. Also increases in efficiency are expected to be achieved by the use of the developed priority system which aims to enable the desired conditions to be attained by the cooling device with a minimum of expended energy in a minimum time.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

We claim:

1. A cooling device comprising two groups of chambers, to be maintained substantially at selected but different temperatures, a first group of chambers comprising a freezer group and a second group of chambers comprising a refrigeration group arranged to be operated at a higher temperature than said freezer group, each group comprising at least one chamber, temperature sensing means arranged to cyclically sense temperature levels in each said group of chambers at substantially predetermined intervals, temperature data storage means adapted to receive and store sensed temperature data and to establish a temperature history for at least one chamber in at least one said group, a refrigeration plant including a compressor, evaporator, and a condenser, a common air flow passageway passing across said evaporator, separate air flow passageways from and to said common air flow passageway for each of said two groups of chambers, said separate air flow passageways each being fed by said common air flow passageway, valve means controlling air flow in each said separate air flow passageway, air flow control means which determine whether each said valve means is to allow, prevent or merely restrict the air flow in a selected said separate air flow passageway, temperature selection means to select a temperature at which said evaporator is to run or at least tend towards, air pressure means to cause air movement in said air flow passageways as controlled by said valve means to effect cyclical cooling of said groups of chambers and controlling said valve means, said air pressure means and said compressor to effect cooling of said groups of chambers and logic sequencing means responsive to data from said temperature data storage means and arranged to pass signals to said cycle control means to control the sequence of actuation of said air pressure means, said valve means and said compressor in accordance with said data obtained from said temperature data storage means and said programmed instructions in a sequence such that cooling of said freezer group is effected by causing air to flow through said freezer group but not said refrigeration group and over said evaporator with said compressor being energized or not depending on the sensed temperature data in said temperature data storage means from said freezer group, and, provided the sensed temperature in said freezer group has substantially reached a predetermined low temperature to said cycle control means and an appropriate signal has been given by said logic sequencing means indicating that cooling is required in said refrigeration group, said cycle control means causes air to flow through said refrigeration group but not through said freezer group and over said evaporator with said compressor being energized or not depending on the sensed temperature data in said temperature data storage means from said refrigeration group, both said air pressure means and said compressor being de-energized by said cycle control means when the sensed temperature in said refrigeration group is at or near a predetermined low temperature, selected ones of the above sequences being then cyclically followed according to signals received by said cycle control means from said logic sequencing means as a result of cyclically sensing the temperatures of said freezer and refrigeration groups of chambers.

2. A cooling device as claimed in claim 1 wherein said sensed temperature data also comprises an average temperature for at least one chamber in at least one said group, said average temperature being determined by said logic sequencing means from said temperature history and said sensed temperature.

3. A cooling device as claimed in claim 1 wherein said freezer group comprises one chamber and said refrigeration group comprises two chambers.

4. A cooling device as claimed in claim 3 wherein said freezer group comprises one chamber to be substantially maintained at a selected temperature and said refrigerator group comprises two chambers, one of said refrigeration group chambers to be maintained at a selected temperature, warmer than said freezer chamber temperature, and the other being a variable temperature chamber to be maintained at a desired temperature set by the user.

5. A cooling device as claimed in claim 1 wherein at least two selectable flow control means are provided between said evaporator and said condenser, said at least two flow control means having different flow capacities.

6. A cooling device as claimed in claim 4 wherein at least two selectable flow control means are provided between said evaporator and said condenser, said at least two flow control means having different flow capacities.

7. A cooling device as claimed in claim 5 wherein said at least two flow control means comprise two capillaries, appropriate selection of said capillaries being made in the cyclical operation of the cooling device by said cycle control means depending on the signals received from said logic sequencing means in response to the data stored in said temperature data storage means.

8. A cooling device as claimed in claim 6 wherein said at least two flow control means comprise two capillaries, appropriate selection of said capillaries being made in the cyclical operation of the cooling device by said cycle control means depending on the signals received from said logic sequencing means in response to the data stored in said temperature data storage means.

9. A cooling device comprising:

at least two chambers to be substantially maintained at selected but different temperatures;

a refrigeration plant including an evaporator and a condenser containing refrigerant;

a common air flow passageway across said evaporator;

separate air flow passageways from and to said at least two chambers, said separate air flow passageways each being fed by said common air flow passageway passing across said evaporator;

valve means in each of said separate air flow passageways;

sensing means to sense the temperature of a selected one or ones of said at least two chambers;

pressure means to move air through said air flow passageways;

and control means sensitive to said sensing means which controls the operation of the cooling device such that the state of said refrigeration plant, said pressure means and said valve means are altered in such a way as to maintain a first of said at least two chambers within first preset temperature limits until the temperature of a second chamber exceeds second preset temperature limits, at which time said refrigeration plant is placed in an off state, the states of said valve means are then altered to allow air cooled by the thermal inertia of said evaporator to pass through the passageway to said second chamber, and if either the average temperature or the difference in temperature above said preset limits within a chamber exceed further preset limits then said refrigeration plant and said pressure means are placed in an on state and said valve means are placed in states to cause air passing over the evaporator to enter that chamber to cool it within its preset limits.

10. A cooling device as claimed in claim 9 wherein said at least two chambers comprise:

a refrigerated compartment to be maintained at a selected refrigerator temperature;

a freezer compartment to be maintained at a selected temperature, colder than said refrigerator temperature; and a variable temperature compartment to be maintained selectively at a desired temperature set by the user.

11. A cooling device as claimed in claim 9 wherein said refrigeration plant also includes at least two refrigerant flow control means between said evaporator and said condenser, said at least two flow control means having different flow capacities.

12. A cooling device as claimed in claim 11 wherein said at least two flow control means comprise at least two capillaries having different capillary volumes.

13. A cooling device as claimed in claim 12 wherein said control means directs refrigerant through a selected at least one of said at least two capillaries, the selection of said at least one capillary being made depending on the required temperature of said evaporator.

* * * * *